US011230853B2

(12) United States Patent
Speciale

(10) Patent No.: US 11,230,853 B2
(45) Date of Patent: Jan. 25, 2022

(54) LARGE CAPACITY ABOVE GROUND IMPOUNDMENT TANK

(71) Applicant: JWF Industries, Johnstown, PA (US)

(72) Inventor: Marc Joseph Speciale, Johnstown, PA (US)

(73) Assignee: JWF Industries, Johnstown, PA (US)

( * ) Notice: Subject to any disclaimer, the term of this patent is extended or adjusted under 35 U.S.C. 154(b) by 0 days.

(21) Appl. No.: 14/260,774

(22) Filed: Apr. 24, 2014

(65) Prior Publication Data

US 2014/0319130 A1 Oct. 30, 2014

Related U.S. Application Data

(60) Provisional application No. 61/815,388, filed on Apr. 24, 2013.

(51) Int. Cl.

| | |
|---|---|
| ***E04H 7/02*** | (2006.01) |
| ***E04H 7/04*** | (2006.01) |
| ***B65D 90/08*** | (2006.01) |

(52) U.S. Cl.

CPC ..... *E04H 7/02* (2013.01); *B65D 90/08* (2013.01); *E04H 7/04* (2013.01); *Y10T 29/49895* (2015.01)

(58) Field of Classification Search

CPC ..... B65D 88/06; B65D 88/1675; B65D 90/0033; E04H 7/30; E04H 2007/225; E04H 12/08

USPC ..... 220/4.12, 565, 567, 608, 669, 1.5; 29/457, 897.32

See application file for complete search history.

(56) References Cited

U.S. PATENT DOCUMENTS

| | | | | |
|---|---|---|---|---|
| 730,344 | A | 6/1903 | Clayton, Sr. | |
| 1,076,382 | A * | 10/1913 | Maloney | B65D 90/08 220/4.17 |
| 1,416,849 | A | 5/1922 | Loop | |
| 1,631,051 | A * | 5/1927 | Nichols | B65D 90/08 220/4.12 |
| 2,094,589 | A | 10/1937 | Day | |
| 2,119,518 | A | 6/1938 | Boardman | |
| 2,380,089 | A | 7/1945 | Ulm | |
| 2,532,854 | A | 12/1950 | Plummer | |
| 2,533,041 | A | 12/1950 | Plummer | |
| 2,684,173 | A | 7/1954 | Schmitz | |

(Continued)

*Primary Examiner* — Anthony D Stashick
*Assistant Examiner* — James M Van Buskirk
(74) *Attorney, Agent, or Firm* — The Webb Law Firm

(57) ABSTRACT

A large capacity above ground impoundment tank includes a number of first-level interlocking panels connected to one another to form a generally circular tank. The first-level interlocking panels include a plate, a first flange, a second flange, a third flange, and a fourth flange. The first-level interlocking panels include at least retaining rib and at least one vertical support member. The third flange of each first-level interlocking panel includes a guide pin. The first flange of a first-level interlocking panel is connected via suitable fasteners to the second flange of an adjacent first-level interlocking panel. A number of second-level interlocking panels may be positioned on a top surface of the first-level interlocking panels. The second-level interlocking panels may be similar to the first-level interlocking panels. The guide pin of a first-level interlocking panel is inserted into a corresponding guide pin hole on the fourth flange of a corresponding second-level panel.

18 Claims, 5 Drawing Sheets

(56) References Cited

U.S. PATENT DOCUMENTS

| | | | | |
|---|---|---|---|---|
| 3,062,402 | A | 11/1962 | Farrell et al. | |
| 3,096,901 | A | 7/1963 | Arne | |
| 3,112,044 | A | 11/1963 | Larsen et al. | |
| 3,302,825 | A | 2/1967 | Schleeweiss | |
| 3,316,721 | A | 5/1967 | Heilig | |
| D211,723 | S | 7/1968 | Vroman | |
| 3,409,161 | A | 11/1968 | Arne | |
| 3,460,705 | A | 8/1969 | Green | |
| 3,648,303 | A | 3/1972 | Stewart et al. | |
| 3,819,079 | A | 6/1974 | Levens | |
| 4,075,801 | A | 2/1978 | Alper et al. | |
| D253,051 | S | 10/1979 | Pletcher | |
| 4,193,510 | A | 3/1980 | Weston | |
| 4,240,562 | A | 12/1980 | Holschlag | |
| 4,473,978 | A | 10/1984 | Wood | |
| 4,651,401 | A | 3/1987 | Arbella | |
| 4,756,033 | A | 7/1988 | Schelfhorst | |
| 4,760,932 | A | 8/1988 | Rhodes, Jr. | |
| D298,273 | S | 10/1988 | Cobb | |
| 4,881,847 | A | 11/1989 | Sandels | |
| 4,890,343 | A | 1/1990 | Schlags | |
| 4,989,751 | A | 2/1991 | Gillett | |
| 5,197,627 | A * | 3/1993 | Disabato | B65D 90/24 220/23.83 |
| 5,222,618 | A | 6/1993 | Koch | |
| 5,375,733 | A | 12/1994 | Kohler et al. | |
| 5,454,195 | A | 10/1995 | Hallsten | |
| 5,462,193 | A | 10/1995 | Schoo | |
| 5,582,311 | A | 12/1996 | Bartenstein et al. | |
| 5,671,855 | A | 9/1997 | Norman, Jr. et al. | |
| 5,689,920 | A | 11/1997 | Hallsten | |
| 6,390,325 | B1 | 5/2002 | Gonzales | |
| 6,676,333 | B2 | 1/2004 | Wiseman et al. | |
| 6,715,243 | B1 | 4/2004 | Fons | |
| 7,188,747 | B2 | 3/2007 | Bennett et al. | |
| 7,574,834 | B2 | 8/2009 | Murray | |
| 7,614,825 | B2 | 11/2009 | Kroger | |
| 7,905,368 | B1 | 3/2011 | Christensen | |
| 7,934,619 | B1 | 5/2011 | Robertson | |
| 8,136,177 | B2 | 3/2012 | Kan | |
| 8,191,723 | B2 | 6/2012 | Donaldson | |
| 8,365,937 | B2 | 2/2013 | Lovelace et al. | |
| 8,534,480 | B1 | 9/2013 | Hanna | |
| 8,590,727 | B2 | 11/2013 | Dupuis et al. | |
| D728,731 | S | 5/2015 | Ellis | |
| 2009/0283522 | A1 | 11/2009 | Donaldson | |
| 2010/0025407 | A1 | 2/2010 | Benson | |
| 2010/0209199 | A1* | 8/2010 | Pogue | E02D 17/08 405/282 |
| 2010/0243657 | A1 | 9/2010 | Johnson et al. | |
| 2011/0168728 | A1 | 7/2011 | McDermott et al. | |
| 2011/0289865 | A1 | 12/2011 | Martens et al. | |
| 2012/0073675 | A1 | 3/2012 | Dupuis et al. | |
| 2012/0076588 | A1 | 3/2012 | Dupuis et al. | |
| 2012/0152960 | A1 | 6/2012 | Toews et al. | |
| 2012/0223073 | A1 | 9/2012 | Lovelace et al. | |
| 2012/0234829 | A1 | 9/2012 | Lovelace et al. | |
| 2012/0255957 | A1 | 10/2012 | McGowen | |
| 2012/0261414 | A1 | 10/2012 | Mann et al. | |
| 2013/0020331 | A1 | 1/2013 | Davis et al. | |
| 2013/0087558 | A1 | 4/2013 | Bohley et al. | |
| 2013/0098906 | A1 | 4/2013 | Lovelace et al. | |
| 2013/0105475 | A1 | 5/2013 | Marshall | |
| 2013/0319552 | A1* | 12/2013 | Svarczkopf | B65D 13/00 137/565.01 |
| 2013/0327776 | A1 | 12/2013 | Raybuck et al. | |
| 2014/0069932 | A1 | 3/2014 | Musso | |
| 2014/0083554 | A1* | 3/2014 | Harris | B65D 88/32 141/1 |
| 2014/0166648 | A1 | 6/2014 | Iwashita | |
| 2014/0197166 | A1 | 7/2014 | Raybuck et al. | |
| 2015/0144624 | A1 | 5/2015 | Noles, Jr. et al. | |
| 2016/0152411 | A1 | 6/2016 | Corbeil | |
| 2017/0101260 | A1 | 4/2017 | Steinke | |

* cited by examiner

LARGE CAPACITY ABOVE GROUND IMPOUNDMENT TANK

CROSS REFERENCE TO RELATED APPLICATION

This application claims the benefit of U.S. Provisional Application No. 61/815,388, filed Apr. 24, 2013, the disclosure of which is hereby incorporated in its entirety by reference.

BACKGROUND OF THE INVENTION

Field of the Invention

This disclosure relates generally to large capacity tanks and, more particularly, to modular large capacity above ground impoundment tanks.

Description of Related Art

Currently in the oil and gas industry, large capacity tanks are needed, for example, to store fracturing fluid produced from a drilling process used to obtain the oil or gas. One method of storing this fluid is to use trailers transported to the work site to be filled during the drilling process. These trailers hold a limited amount of fluid and require frequent driving between the work site and the area used for disposing of the fracturing fluid. This method requires either multiple trucks located at the work site to keep a continuous drilling process running, or the drilling process has to be stopped until the truck hauling the trailer returns from disposing of the previous load of fracturing fluid.

Another method for storing fracturing fluid on the work site includes using large capacity tanks. These tanks are often transported to the work site as one unit or, if the tank is relatively large, they are transported in bulk pieces to be assembled at the work site. Once the pieces are delivered to the work site, workers must assemble the individual pieces according to the proper installation position of each piece. This requires an extended period of time to install and can slow down the drilling process at the work site. The pieces must be properly aligned before being connected, which requires a certain amount of precision in positioning each piece relative to one another.

There exists a current need for an improved large capacity above ground impoundment tank that is easily transported, assembled, and installed. Additionally, there is a need for a large capacity tank that provides an improved way to assemble the individual pieces of the tank, thereby decreasing the amount of time used for installing the tank.

SUMMARY OF THE INVENTION

In one embodiment, an interlocking panel for a large capacity tank is provided. The interlocking panel generally comprises a plate, a first flange, a second flange, a third flange, a fourth flange, at least one retaining rib, and at least one vertical support member. The plate has an outer surface, an inner surface, a bottom edge, a top edge, a first side, and an opposing second side. The first side and the opposing second side of the plate are positioned between the bottom and top edges of the plate. The first flange has an inner surface, an outer surface, and at least one hole extending therethrough. The first flange extends from the first side of the plate. The second flange has an inner surface, an outer surface, and at least one hole extending therethrough. The second flange extends from the second side of the plate. The third flange has an inner surface, an outer surface, at least one hole extending therethrough, and at least one pin extending from the outer surface of the third flange. The third flange extends from the top edge of the plate. The fourth flange has an inner surface, an outer surface, at least one hole extending therethrough, and at least one corresponding guide pin hole extending therethrough. The fourth flange extends from the bottom edge of the plate. The retaining rib is positioned on the outer surface of the plate and extends from the first side of the plate to the opposing second side of the plate. The vertical support member is positioned on the outer surface of the plate and extends between the retaining rib and either the bottom edge of the plate or the top edge of the plate.

The plate, the third flange, the fourth flange, and the retaining rib may have an arcuate, curved shape. The interlocking plate may further comprise a plurality of retaining ribs that are evenly spaced between the top edge of the plate and the bottom edge of the plate and extend from the first side of the plate to the opposing second side of the plate.

The first flange and the second flange may include a plurality of holes extending therethrough. Bottom ends of the first flange and the second flange may have more holes extending therethrough than top ends of the first flange and the second flange.

The interlocking panel may further comprise a plurality of vertical support members positioned on the outer surface of the plate and extending between adjacent retaining ribs. The interlocking panel may further comprise at least one ring attached to an outer surface of at least one retaining rib. The first flange, the second flange, the third flange, and the fourth flange may be integral with the plate. The interlocking panel may further comprise a plurality of pins extending from the outer surface of the third flange.

In another embodiment, a large capacity tank is provided. The large capacity tank comprises a plurality of first-level interlocking panels. The first-level interlocking panels are similar to the interlocking panels described hereinabove. The first-level interlocking panels are connected to each other by suitable fasteners inserted through the at least one hole of the first flange of a first-level interlocking panel and the corresponding at least one hole of the second flange of an adjacent first-level interlocking panel.

The large capacity tank may further comprise a plurality of second-level interlocking panels positioned on the top edges of the corresponding first-level interlocking panels. The second-level interlocking panels are similar to the interlocking panels described hereinabove. The second-level interlocking panels are connected to each other by suitable fasteners inserted through the at least one hole of the first flange of a second-level interlocking panel and the corresponding at least one hole of the second flange of an adjacent second-level interlocking panel.

The second-level interlocking panels may be positioned on the top surface of each first-level interlocking panel by inserting the guide pin on the third flange of each first-level interlocking panel into a corresponding guide pin hole on the fourth flange of each second-level interlocking panel. Each second-level interlocking panel may be connected to a corresponding first-level interlocking panel by inserting suitable fasteners through the at least one hole of the third flange of the first-level interlocking panel and the corresponding at least one hole of the fourth flange of the second-level interlocking panel. Each second-level interlocking panel may be centered above a connection point between two first-level interlocking panels. Each first-level interlocking panel and each second-level interlocking panel may be connected to form a generally circular tank.

The large capacity tank may further comprise a plurality of retaining ribs evenly spaced between the top edge of the each first-level interlocking panel and the bottom edge of each first-level interlocking panel and extending from the first side of each first-level interlocking panel to the opposing second side of each first-level interlocking panel, and a plurality of retaining ribs evenly spaced between the top edge of the each second-level interlocking panel and the bottom edge of each second-level interlocking panel and extending from the first side of each second-level interlocking panel to the opposing second side of each second-level interlocking panel.

Bottom ends of the first flange and the second flange of each first-level interlocking panel may have more holes extending therethrough than top ends of the first flange and the second flange of each first-level interlocking panel. Bottom ends of the first flange and the second flange of each second-level interlocking panel may have more holes extending therethrough than top ends of the first flange and the second flange of each second-level interlocking panel.

The large capacity tank may further comprise a plurality of vertical support members positioned on the outer surface of each first-level interlocking panel and extending between adjacent retaining ribs positioned on the outer surface of each first-level interlocking panel. The large capacity tank may further comprise a plurality of vertical support members positioned on the outer surface of each second-level interlocking panel and extending between adjacent retaining ribs positioned on the outer surface of each second-level interlocking panel.

The first flange, the second, flange, the third flange, and the fourth flange of each first-level and second-level interlocking panel may be integral with the plate of the corresponding first-level and second-level interlocking plate.

In yet another embodiment, a method of assembling a large capacity tank includes the steps of providing at least two first-level, interlocking panels, each first-level, interlocking panel including a top surface, a bottom surface, and at least one guide pin extending from the top surface; providing at least one second-level, interlocking panel including a top surface, a bottom surface, and at least one guide pin hole extending through the bottom surface of the second-level, interlocking panel; connecting a first side of a first-level, interlocking panel to a second side of an adjacent first-level, interlocking panel; positioning the bottom surface of the at least one second-level, interlocking panel on the top surface of each first-level, interlocking panel; and inserting the at least one guide pin of one of the at least two first-level, interlocking panels into the at least one guide pin hole of the at least one second-level, interlocking panel. The at least one second-level, interlocking panel may be substantially centered above a connection point between the at least two first-level, interlocking panels.

Further details and advantages will be understood from the following detailed description read in conjunction with the accompanying figures.

DESCRIPTION OF THE PREFERRED EMBODIMENTS

For purposes of the description hereinafter, spatial orientation terms, as used, shall relate to the referenced embodiment as it is oriented in the accompanying drawings, figures, or otherwise described in the following detailed description. However, it is to be understood that the embodiments described hereinafter may assume many alternative variations and configurations. It is also to be understood that the specific components, devices, features, and operational sequences illustrated in the accompanying drawings figures, or otherwise described herein are simply exemplary and should be considered as limiting.

Figure 1:
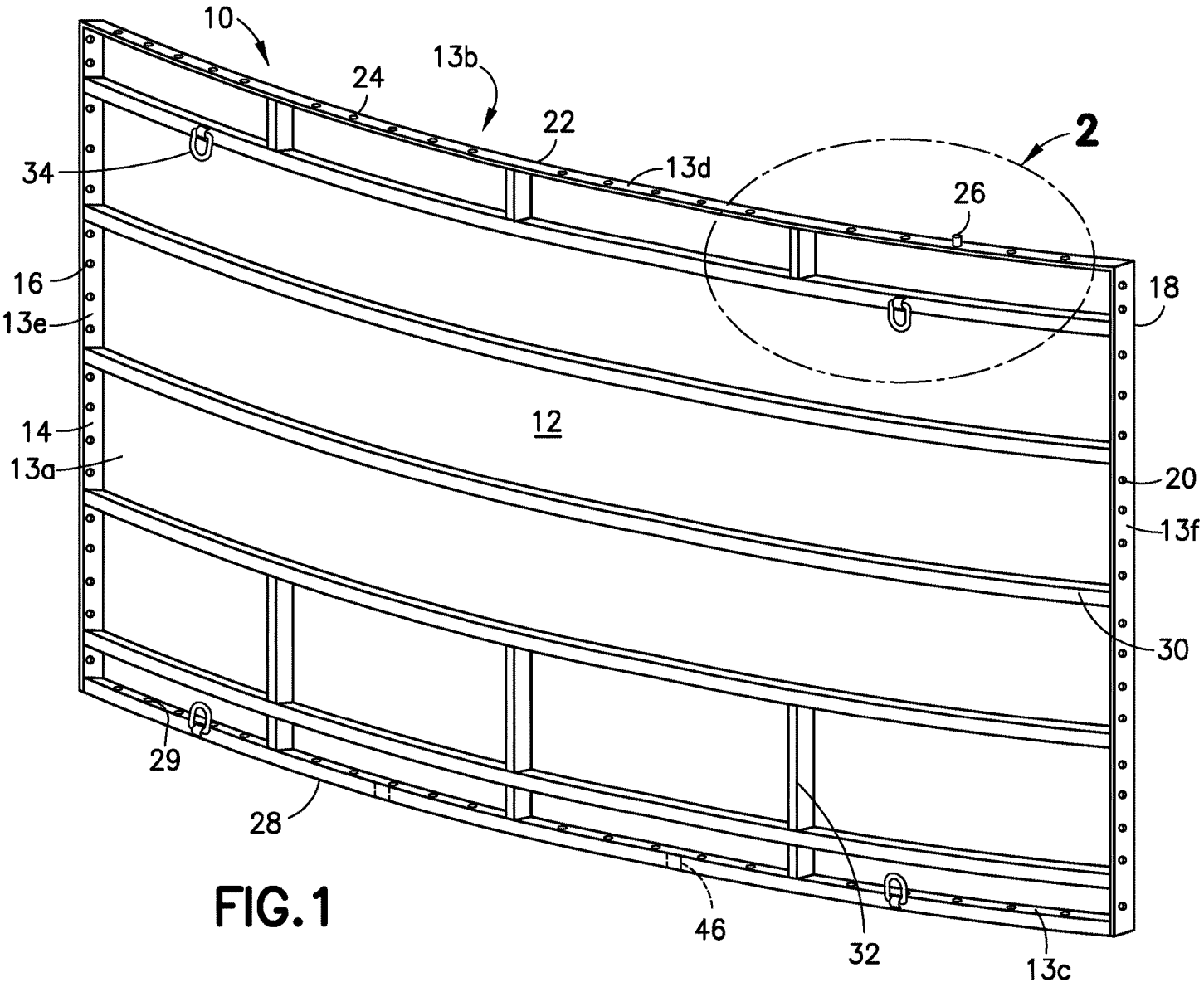
FIG. 1 is a perspective view showing an interlocking panel in accordance with this disclosure.
Figure 2:
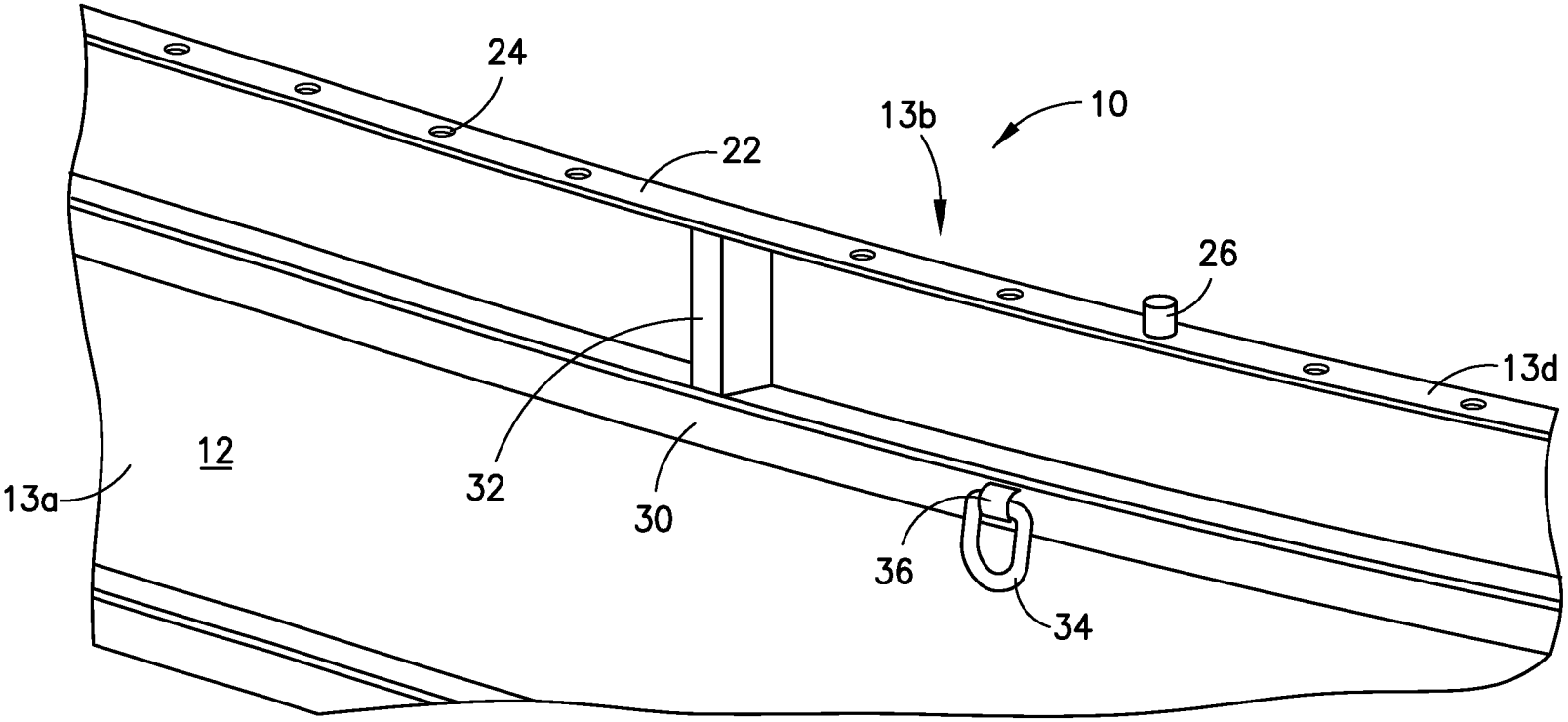
FIG. 2 is an enlarged and isolated view of a detail portion labeled 2 in FIG. 1.

Referring to FIGS. 1 and 2, an interlocking panel 10 for large capacity tanks is shown. The interlocking panel 10 includes a plate 12 with an outer surface 13*a*, an inner surface 13*b* (on the opposite side of the plate 12 as the outer surface 13*a*), a bottom edge 13*c*, a top edge 13*d*, a first side 13*e*, and an opposing second side 13*f*. The first side 13*e* and the opposing second side 13*f* are positioned between the bottom edge 13*c* and the top edge 13*d* of the plate 12. The plate 12 may have an arcuate, curved shape; however, additional shapes are contemplated. The outer surface 13*a* and the inner surface 13*b* of the plate 12 have smooth, continuous surfaces, but it is contemplated that slight imperfections, bumps, or chips may result from the manufacturing process or develop on the inner and outer surfaces 13*a*, 13*b* of the plate 12.

A first flange 14 extends from the first side 13*e* of the plate 12 in the direction of the outer surface 13*a* of the plate 12. The first flange 14 may be welded or fastened to the plate 12, or the first flange 14 may be integral with the plate 12. The first flange 14 has an inner surface, an outer surface, and at least one hole 16 extending therethrough. It is contemplated that a plurality of holes 16 may extend through the first flange 14 along its longitudinal axis, including having a greater number of holes 16 placed at a bottom end of the first flange 14 as compared to the number of holes 16 placed at a top end of the first flange 14. A similar second flange 18 extends from the opposing second side 13*f* of the plate 12 in the direction of the outer surface 13*a* of the plate 12. The second flange 18 may be welded or fastened to the plate 12, or the second flange 18 may be integral with the plate 12. The second flange 18 has an inner surface, an outer surface, and at least one hole 20 extending therethrough. It is also contemplated that a plurality of holes 20 may extend through the second flange 18 along its longitudinal axis, including having a greater number of holes 20 placed at a bottom end of the second flange 18 as compared to the number of holes 20 placed at a top end of the second flange 18.

A third flange 22 extends from the top edge 13*d* of the plate 12 in the direction of the outer surface 13*a* of the plate 12. The third flange 22 may be welded or fastened to the plate 12, or the third flange 22 may be integral with the plate 12. The third flange 22 has an inner surface, an outer surface, at least one hole 24 extending therethrough, and at least one guide pin 26 and, desirably, a plurality of guide pins 26 formed on and extending from the outer surface of the third flange 22. The third flange 22 may have a plurality of holes 24 spaced along its longitudinal axis, including having a plurality of holes 24 evenly spaced apart or in a staggered arrangement. The guide pins 26 on the third flange 22 allow easy assembly of a large capacity tank, enabling workers to assemble several interlocking panels 10 together at a work site. The guide pins 26 are cylindrical, but it is contemplated that additional shapes and sizes may be used to increase ease of use when assembling a large capacity tank. A method of assembling said large capacity tank is described in greater detail below. The guide pins 26 may be located at any position along the longitudinal axis of the third flange 22. It is desired that a plurality of guide pins may be positioned along the longitudinal axis of the third flange 22 to assist in assembling a large capacity tank. The third flange 22 may have an arcuate, curved shape corresponding to the shape of the plate 12; however, additional shapes are contemplated.

A fourth flange 28 extends from the bottom edge 13*c* of the plate 12 in the direction of the outer surface 13*a* of the plate 12. The fourth flange 28 may be welded or fastened to the plate 12, or the fourth flange 28 may be integral with the plate 12. The fourth flange 28 has an inner surface, an outer surface, at least one hole 29 extending therethrough, and at least one corresponding guide pin hole 46 extending therethrough, as shown in phantom in FIG. 1. The fourth flange 28 has a corresponding number of guide pin holes 46 according to the number of guide pins 26 that are provided on the third flange 22. The fourth flange 28 may have a plurality of holes 29 spaced along its longitudinal axis, including having a plurality of holes 29 evenly spaced apart or in a staggered arrangement. The fourth flange 28 may have an arcuate, curved shape corresponding to the shape of the plate 12; however, additional shapes are contemplated.

The interlocking panel 10 also includes at least one or, typically, a plurality of retaining ribs 30 which are positioned on the outer surface 13*a* of the plate 12. The retaining ribs 30 extend from the first side 13*e* of the plate 12 to the second side 13*f* of the plate 12 and have a square cross-sectional shape; however, additional cross-sectional shapes are contemplated. The retaining ribs 30 may be positioned on the plate 12 by welding or fastening the retaining ribs 30 to the plate 12 or the retaining ribs 30 may be integral with the plate 12. It is desired that a plurality of retaining ribs 30 may be spaced between the top edge 13*d* of the plate 12 and the bottom edge 13*c* of the plate 12, including, among others, an arrangement where the retaining ribs 30 are evenly spaced apart or an arrangement where the retaining ribs 30 are staggered along the plate 12. The retaining ribs 30 may have an arcuate, curved shape corresponding to the shape of the plate 12; however, additional shapes are contemplated. The retaining ribs 30 help to contain pressure exerted on the plate 12 as the plate 12 is pushed outwardly by the fluid stored in the large capacity tank. The retaining ribs 30 add additional support to the center of the plate 12 to prevent outward bulging of the plate 12. By adding additional retaining ribs 30, greater support is applied to the plate 12 preventing bulging, fatigue, or weakening of the plate 12 against the pressure of the stored fluid. In one embodiment, a greater number of retaining ribs 30 are placed towards the bottom edge 13*c* of the plate 12 to support the plate 12 against the greater amount of pressure that builds up at the bottom of the large capacity tank.

At least one or, typically, a plurality of vertical support members 32 are also positioned on the outer surface 13*a* of the plate 12. The vertical support members 32 may be positioned on the plate 12 by welding or fastening or the vertical support members 32 may be integral with the plate 12. The vertical support members 32 have a square cross-sectional shape, but additional cross-sectional shapes are contemplated. The vertical support members 32 are positioned between the retaining ribs 30 and, additionally or alternatively, either the top edge 13*d* or the bottom edge 13*c* of the plate 12. In an embodiment where a plurality of retaining ribs 30 are positioned on the outer surface 13*a* of the plate 12, a plurality of vertical support members 32 may also be positioned between adjacent retaining ribs 30. Either one or a plurality of vertical support members 32 may be positioned between adjacent retaining ribs 30 along the longitudinal axis of the plate 12 depending on the amount of fluid pressure being directed against the plate 12. The vertical support members 32 work to add support to the retaining ribs 30 when a great amount of fluid pressure is directed against the plate 12. The retaining ribs 30 may need additional support towards the center of the retaining ribs 30, which can be provided by the vertical support member 32. The vertical support members 32 may be evenly spaced apart along the longitudinal axis of the plate 12, or may be arranged in a staggered formation.

At least one or, typically, a plurality of lifting rings 34 may also be attached to the retaining ribs 30. The lifting rings 34 are attached by welding or fastening a U-shaped bracket 36 to an outer surface of the retaining rib 30 and inserting the lifting ring 34 therethrough. The U-shaped bracket 36 may also be integral with the designated retaining rib 30. It is also contemplated that additional attachment means may be used in place of a U-shaped bracket, including, among others, a square-shaped bracket or an angle bracket. In one embodiment, a plurality of lifting rings 34 can be placed along the outer surface of the retaining rib 30. The lifting rings 34 allow an individual to place the interlocking panel 10 at a desired location. Through the use of lifting machinery, such as a crane or forklift, the individual can loop straps through the ring 34 and hoist the interlocking panel 10 into the air. After moving the interlocking panel 10 to the desired location, the interlocking panel 10 is lowered and positioned by the individual.

Figure 3:
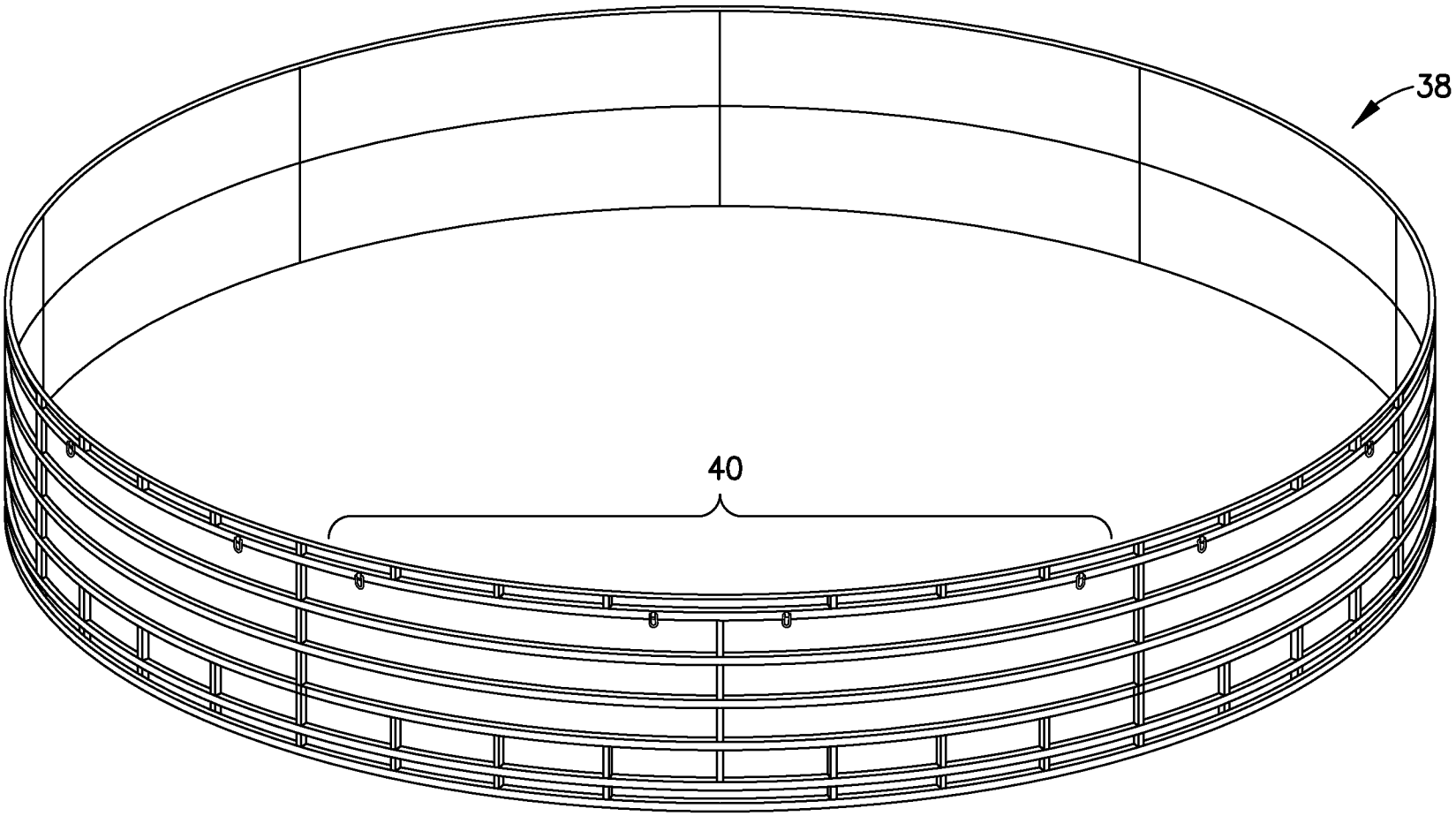
FIG. 3 is a perspective view showing a large capacity tank with one level of interlocking panels in accordance with this disclosure.
Figure 4:
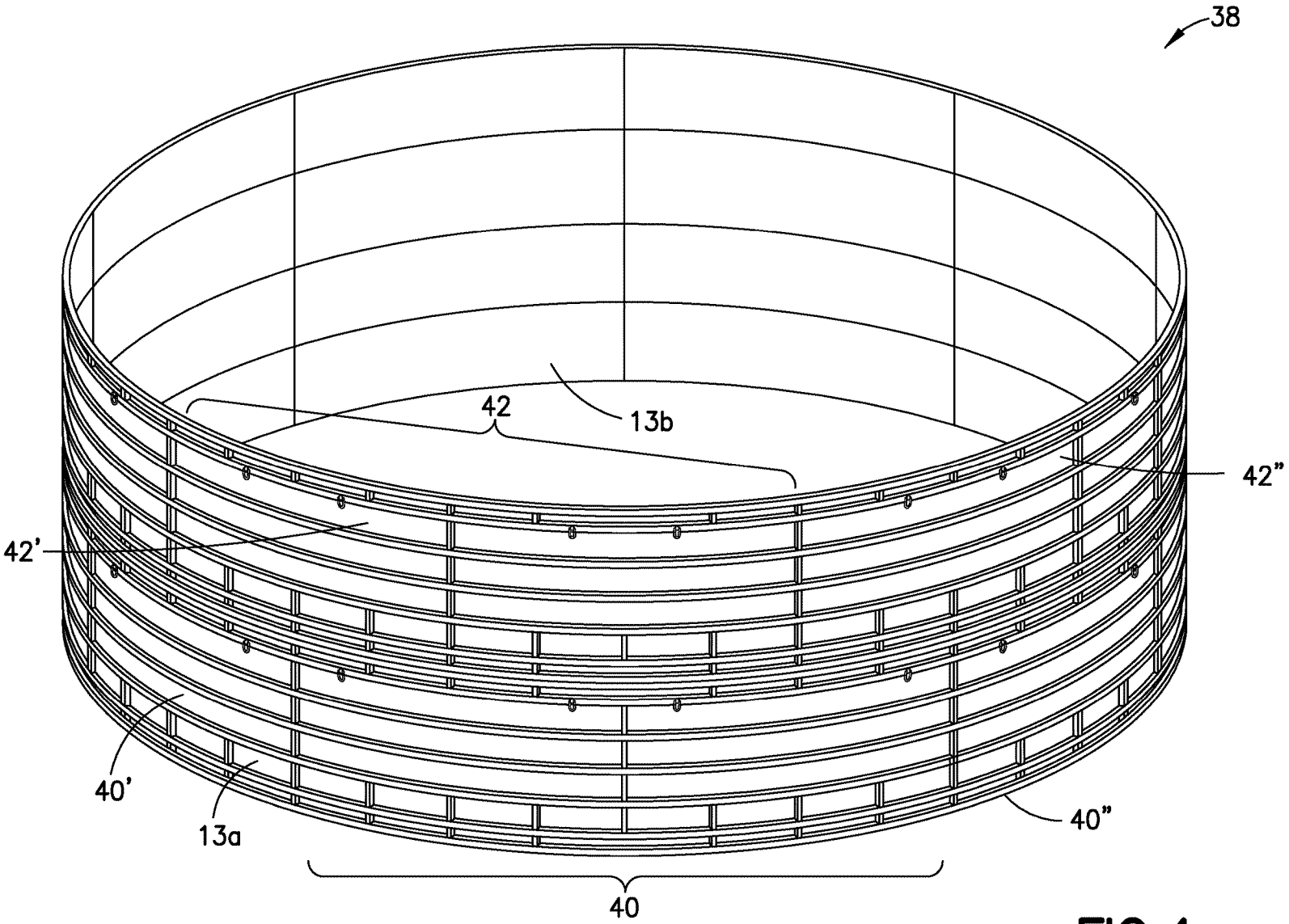
FIG. 4 is a perspective view showing a large capacity tank with two levels of interlocking panels in accordance with this disclosure.
Figure 5:
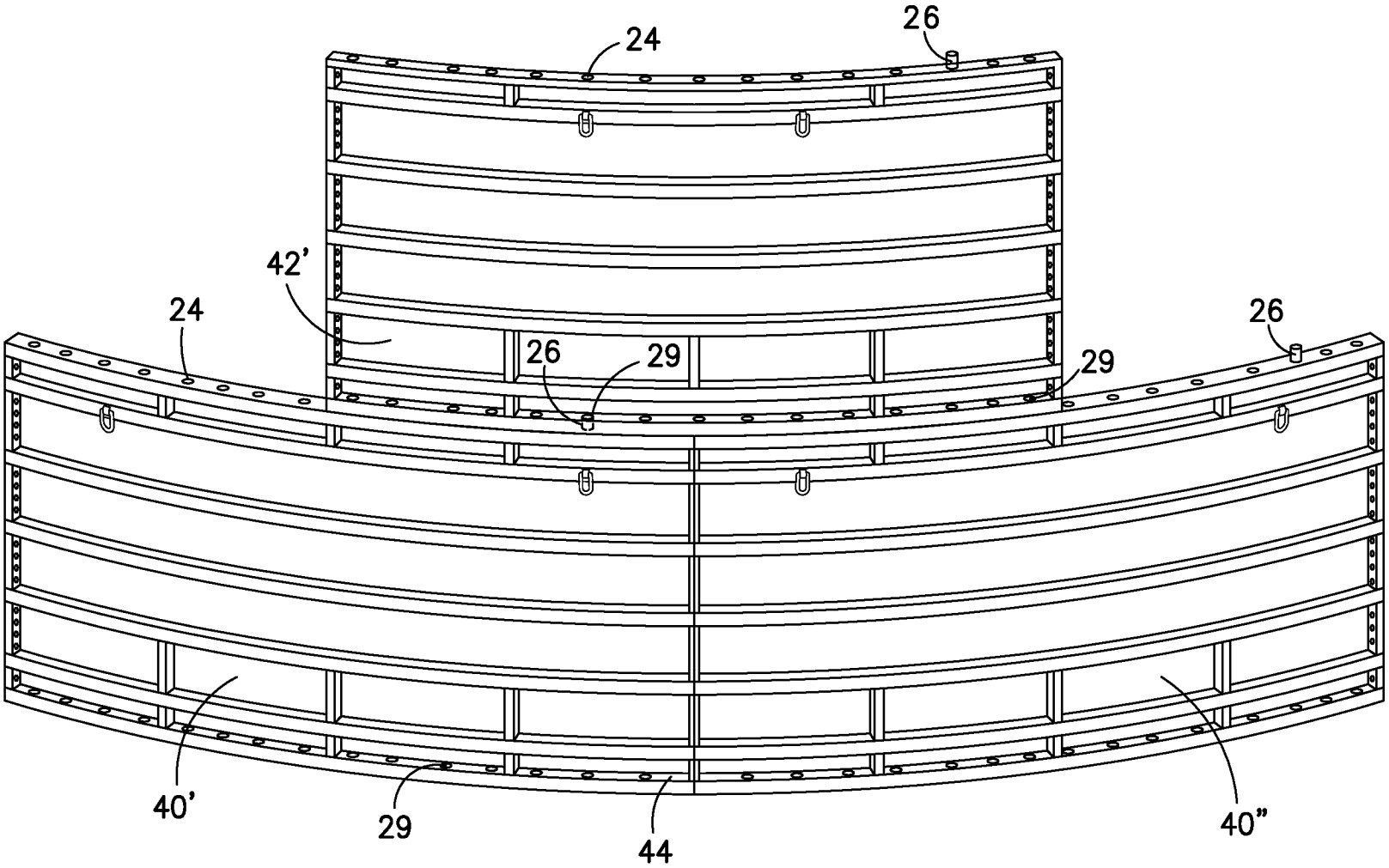
FIG. 5 is an isolated view of the connection of the first-level interlocking panels to the second-level interlocking panels of the large capacity tank shown in FIG. 4.

Referring to FIGS. 3-5, a large capacity above ground impoundment tank 38 is described. The large capacity tank 38 is formed by connecting a plurality of first-level interlocking panels 40 together. Each first-level interlocking panel 40 is identical to the interlocking panel 10 as described hereinabove. For assembly of the large capacity tank 38, the first-level interlocking panels 40 are connected together at a connection joint 44 using suitable fasteners inserted through the holes 16 of the first flange 14 of a first-level interlocking panel 40" and the corresponding holes 20 of the second flange 18 of an adjacent first-level interlocking panel 40'. The suitable fasteners may be, among others, nuts and bolts or retaining pins for holding the first-level interlocking panels together. As discussed above in relation to the interlocking panel 10, the bottom ends of the first flange 14 and the second flange 18 may include a greater number of fastener holes (16, 20) than the top ends of each flange. This arrangement is used to give additional support to the bottom portions of each interlocking panel 10 against the high fluid pressure that develops at the bottom of the large capacity tank 38. By increasing the amount of fasteners used on the bottom of the first flange 14 and second flange 18, a stronger, tighter connection between the interlocking panels 40', 40" is achieved. The plurality of first-level interlocking panels 40 may be connected to form a generally circular tank.

Referring to FIG. 4, a multi-level large capacity tank 38 is described. In certain circumstances, one level of interlocking panels 10 may not provide the desired volume to hold the desired amount of liquid. In this situation, an individual may add a second level of interlocking panels 42 to create a larger tank 38. A plurality of second-level interlocking panels 42 may be positioned on the top edges of the corresponding first-level interlocking panels 40. Each second-level interlocking panel 42 is identical to the first-level interlocking panels 40, as well as the interlocking panel 10 as described hereinabove. The interlocking panels 10, 40, 42 are designed to be universal, stackable panels that provide easy transportation between work sites or between a manufacturing location and a customer's work site. The interlocking panels 10, 40, 42 are designed for ease of assembly as well. By creating universally identical interlocking panels, workers do not need to determine where each interlocking panel must be positioned in order to build the large capacity tank 38. Any of the interlocking panels 10, 40, 42 can be used in any section of the large capacity tank 38. A second-level interlocking panel 42 can be used on the first level of the large capacity tank 38 and a first-level interlocking panel 40 can be used on the second level. Additionally, any of the first-level interlocking panels 40 can be positioned adjacent to one another; there is not a specific order that the first-level interlocking panels 40 must be positioned in. This flexibility provides a faster installation time and easier installation process on the work site. An additional advantage of this tank 38 is the ease with which the interlocking panels 10, 40, 42 can be transported. Multiple interlocking panels 10, 40, 42 may be stacked on a truck with little concern as to the order of stacking and transported to the work site relatively easily.

Similar to the connection method of the first-level interlocking panels 40, the second-level interlocking panels 42 are connected together using suitable fasteners inserted through the holes 16 of the first flange 14 of a second-level interlocking panel 42" and the corresponding holes 20 of the second flange 18 of an adjacent second-level interlocking panel 42'. The suitable fasteners may be, among others, nuts and bolts or retaining pins for holding the second-level interlocking panels together. As discussed above in relation to the interlocking panel 10, the bottom ends of the first flange 14 and the second flange 18 may include a greater number of fastener holes (16, 20) than the top ends of each flange. This arrangement is used to give additional support to the bottom portions of each interlocking panel 10 against the high fluid pressure that develops at the bottom of the large capacity tank 38. By increasing the amount of fasteners used on the bottom of the first flange 14 and second flange 18, a stronger, tighter connection between the second-level interlocking panels 42', 42" is achieved. The plurality of second-level interlocking panels 42 may be connected to form a generally circular tank.

The second-level interlocking panels 42 are positioned on the top edges of the first-level interlocking panels 40 to provide a taller, larger tank 38. Each second-level interlocking panel 42 is positioned on the top surface of a corresponding first-level interlocking panel 40 by inserting the guide pin 26 on the third flange 22 of the first-level interlocking panel 40 into a corresponding guide pin hole 46 on the fourth flange 28 of the second-level interlocking panel 42. By using the guide pin 26, workers can easily determine if the second-level interlocking panel 42 is positioned correctly on top of the first-level interlocking panel 40, and the guide pin 26 facilitates the positioning of the second-level interlocking panel 42 on the lower level interlocking panels 40. This positioning feature allows a faster installation time at the work site for the large capacity tank 38. In one embodiment, each second-level interlocking panels 42 is substantially centered over a connection joint 44 of the first-level interlocking panels 40. Thus, the second level of interlocking panels 42 are offset vertically compared to the first level of interlocking panels 40. However, it is contemplated that an individual could position the second-level interlocking panels 42 directly above the first-level interlocking panels 40, respectively. After the guide pin 26 is correctly inserted into the corresponding guide pin hole 46 of the fourth flange of the second-level interlocking panel 42, suitable fasteners are inserted through a plurality of holes extending through the third flange 22 of the first-level interlocking panel 40 and the fourth flange 28 of the second-level interlocking panel 42 to connect the first-level interlocking panel 40 with the corresponding second-level interlocking panel 42. When the guide pin 26 has been properly inserted into the corresponding guide pin hole 46 on the fourth flange 28 of the second-level interlocking plate 42, the holes 24 of the third flange 22 of the first-level interlocking panel 40 and the holes 29 of the fourth flange 28 of the second-level interlocking panel 42 are properly aligned allowing the individual to quickly and easily insert the suitable fasteners therethrough.

A method of installing and assembling a multi-level large capacity tank is also described. Workers first assemble a first-level of interlocking panels 40 at the desired work site. The first-level interlocking panels 40 are similar to one another, therefore, allowing the worker to use any first-level interlocking panel 40 in any position on the large capacity tank. The first-level interlocking panels 40 are connected to one another as described hereinabove using suitable fasteners. After the first level of interlocking panels 40 has been assembled, a second-level of interlocking panels 42 may be installed. An additional level can be added to the large capacity tank 38 to increase the volume of the tank 38 for work sites that require a greater volume for storing work site fluids. The second-level interlocking panels 42 are positioned on the top edges of the first-level interlocking panels 40. The guide pin 26 of the third flange 22 of the first-level interlocking panel 40 is inserted into the corresponding guide pin hole 46 of the fourth flange 28 of the second-level interlocking panel 42. By using the guide pin 26 and the corresponding guide pin hole 46, workers can easily and quickly position the second-level interlocking panel 42 on the first-level interlocking panel 40. This ensures that the correct positioning of each level of panels is achieved quickly and correctly every time. In one embodiment, the guide pin 26 of the first-level interlocking panel 40 ensures that each second-level interlocking panel 42 is centered above a connection joint 44 of two first-level interlocking panels 40, creating a vertical overlap between the two first-level interlocking panels 40 and the upper, second-level interlocking panel 42. The second-level interlocking panels 42 are then connected via suitable fasteners by the worker as described hereinabove. Additionally, the second-level interlocking panels 42 are connected to the first-level interlocking panels 40 via suitable fasteners by the worker as described hereinabove. As shown in FIG. 5, while the connection joint 44 is located roughly at a midpoint of the upper, second-level interlocking panel 42 due to the location of the guide pins 26 and guide pin holes 46, this specific configuration should not be deemed exclusive or limiting. The locations for the guide pins 26 and the guide pin holes 46 in the universal interlocking panel 10 of this disclosure may be provided at other locations to alter the degree of vertical overlap for each of the upper, second-level interlocking panels 42 relative to the two corresponding lower, first-level interlocking panels 40 or no overlap may be present if so desired. In this latter configuration, each upper, second-level interlocking panel 42 is registered directly above a corresponding lower, first-level interlocking panel 40.

While an embodiment of a large capacity above ground impoundment tank is shown in the accompanying figures and described hereinabove in detail, other embodiments will be apparent to, and readily made by, those skilled in the art without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. An interlocking panel for constructing large capacity tanks, comprising:

a plate with an outer surface, an inner surface, a bottom edge, a top edge, a first side edge, and a second side edge opposite the first side edge;

a first flange extending from the first side edge of the plate and having at least one fastener hole extending through the first flange;

a second flange extending from the second side edge of the plate and having at least one fastener hole extending through the second flange;

a third flange extending from the top edge of the plate and having at least one fastener hole extending through the third flange;

a fourth flange extending from the bottom edge of the plate; and at least one guide pin provided on the third flange and configured to extend into at least one guide pin hole of an identical second interlocking panel positioned above the interlocking panel, wherein the at least one guide pin is located on the third flange to engage the at least one guide pin hole of the second interlocking panel such that the identical second interlocking panel is offset vertically relative to the interlocking panel located below the second interlocking panel, and wherein the first flange and the second flange comprise a plurality of fastener holes extending therethrough, and wherein bottom ends of the first flange and the second flange include a greater number of fastener holes than top ends thereof to provide additional support against fluid pressure that develops in the bottom of the large capacity tanks.

2. The interlocking panel of claim 1, wherein the plate and each of the third flange and the fourth flange have an arcuate shape.

3. The interlocking panel of claim 1, further comprising a plurality of retaining ribs on the outer surface of the plate and extending between the first flange on the first side edge of the plate and the opposing second flange on the second side edge of the plate.

4. The interlocking panel of claim 3, wherein the plurality of retaining ribs are evenly spaced between the third flange at the top edge of the plate and the fourth flange at the bottom edge of the plate.

5. The interlocking panel of claim 3, further comprising a plurality of vertical support members positioned on the outer surface of the plate and extending between the retaining ribs on the outer surface of the plate.

6. The interlocking panel of claim 5, wherein the vertical support members extend between adjacent retaining ribs on the outer surface of the plate.

7. The interlocking panel of claim 3, further comprising a plurality of vertical support members positioned on the outer surface of the plate and extending between at least one of the third flange and one of the retaining ribs and the fourth flange and one of the retaining ribs.

8. The interlocking panel of claim 3, further comprising at least one ring attached to at least one retaining rib.

9. An above ground large capacity tank, comprising:

a plurality of identical, stacked, and interlocked interlocking panels, each of the interlocking panels comprising:

a plate with an outer surface, an inner surface, a bottom edge, a top edge, a first side edge, and a second side edge opposite the first side edge;

a first flange extending from the first side edge of the plate and having at least one fastener hole extending through the first flange;

a second flange extending from the second side edge of the plate and having at least one fastener hole extending through the second flange;

a third flange extending from the top edge of the plate and having at least one fastener hole extending through the third flange;

a fourth flange extending from the bottom edge of the plate; and at least one guide pin provided on the third flange and configured to extend into at least one guide pin hole of a second interlocking panel positioned above and engaged with a first interlocking panel, wherein the at least one guide pin is located on the third flange to engage the at least one guide pin hole of the second interlocking panel such that the second interlocking panel is offset vertically relative to the first interlocking panel located below the second interlocking panel, and wherein the first flange and the second flange comprise a plurality of fastener holes extending therethrough, and wherein bottom ends of the first flange and the second flange include a greater number of fastener holes than top ends thereof to provide additional support against fluid pressure that develops in the bottom of the large capacity tank.

10. The large capacity tank of claim 9, wherein the plate and each of the third flange and the fourth flange have an arcuate shape.

11. The large capacity tank of claim 9, further comprising a plurality of retaining ribs on the outer surface of the plate and extending between the first flange on the first side edge of the plate and the opposing second flange on the second side edge of the plate.

12. The large capacity tank of claim 11, wherein the plurality of retaining ribs are evenly spaced between the third flange at the top edge of the plate and the fourth flange at the bottom edge of the plate.

13. The large capacity tank of claim 11, further comprising a plurality of vertical support members positioned on the outer surface of the plate and extending between the retaining ribs on the outer surface of the plate.

14. The large capacity tank of claim 13, wherein the vertical support members extend between adjacent retaining ribs on the outer surface of the plate.

15. The large capacity tank of claim 11, further comprising a plurality of vertical support members positioned on the outer surface of the plate and extending between at least one of the third flange and one of the retaining ribs and the fourth flange and one of the retaining ribs.

16. The large capacity tank of claim 11, further comprising at least one ring attached to at least one retaining rib.

17. A method of assembling an above ground large capacity tank, comprising the steps of:

providing a plurality of identical interlocking panels, each of the interlocking panels comprising:

a plate with an outer surface, an inner surface, a bottom edge, a top edge, a first side edge, and a second side edge opposite the first side edge;

a first flange extending from the first side edge of the plate and having at least one fastener hole extending through the first flange;

a second flange extending from the second side edge of the plate and having at least one fastener hole extending through the second flange;

a third flange extending from the top edge of the plate and having at least one fastener hole extending through the third flange;

a fourth flange extending from the bottom edge of the plate; and at least one guide pin provided on the third flange and configured to extend into at least one guide pin hole of a second interlocking panel positioned above a first interlocking panel, wherein the first flange and the second flange comprise a plurality of fastener holes extending therethrough, and wherein bottom ends of the first flange and the second flange include a greater number of fastener holes than top ends thereof to provide additional support against fluid pressure that develops in the bottom of the large capacity tank;

positioning the second interlocking panel above the first interlocking panel; and receiving the at least one guide pin of the first interlocking panel into the at least one guide pin hole of the second interlocking panel to interlock the second interlocking panel with the first interlocking panel, such that the second interlocking panel is offset vertically relative to the first interlocking panel located below the second interlocking panel.

18. The method of claim 17, wherein the at least one fastener hole in the third flange of the second interlocking panel is aligned with the at least one fastener hole in the fourth flange of the first interlocking panel when the at least one guide pin is received into the at least one guide pin hole; and further comprising inserting a fastener through the at least one fastener hole in the third flange of the second interlocking panel and the at least one fastener hole in the fourth flange of the first interlocking panel.

* * * * *